United States Patent [19]

Wollensak

[11] 4,341,481

[45] Jul. 27, 1982

[54] WRITING INSTRUMENT WITH BARREL AND FERRULE ASSEMBLY

[75] Inventor: Daniel W. Wollensak, Elmhurst, Ill.

[73] Assignee: Sanford Research Company, Bellwood, Ill.

[21] Appl. No.: 189,051

[22] Filed: Sep. 22, 1980

[51] Int. Cl.[3] ..... B43K 15/00; B43K 8/00; B43K 3/00

[52] U.S. Cl. ..... 401/251; 285/330; 401/196; 401/199; 401/207; 401/209

[58] Field of Search ..... 401/196, 198, 199, 207, 401/251, 212, 214, 202, 209, 216, 241; 285/330

[56] References Cited

U.S. PATENT DOCUMENTS

| | | | |
|---|---|---|---|
| 3,145,412 | 8/1964 | Levy | 401/207 X |
| 3,171,196 | 3/1965 | Helitas . | |
| 3,230,574 | 1/1966 | Kershaw | 401/198 |
| 3,249,377 | 5/1966 | Weasler | 285/330 X |
| 3,356,440 | 12/1967 | Darst . | |
| 3,544,229 | 12/1970 | Aoki et al. . | |
| 3,554,658 | 1/1971 | Malm et al. . | |
| 3,592,552 | 7/1971 | Malm . | |
| 3,659,953 | 5/1972 | Taylor . | |

FOREIGN PATENT DOCUMENTS

| | | | |
|---|---|---|---|
| 1461598 | 1/1969 | Fed. Rep. of Germany . | |
| 970015 | 12/1950 | France | 401/209 |
| 1203006 | 1/1960 | France | 401/209 |
| 609616 | 3/1979 | Switzerland | 401/216 |

*Primary Examiner*—Steven A. Bratlie

*Attorney, Agent, or Firm*—Wegner, Stellman, Wood & Dalton

[57] ABSTRACT

A housing assembly for a writing instrument is provided comprising a long, hollow barrel member and a ferrule member assembled in end-to-end relationship to afford an inner chamber for a reservoir of marking fluid. A writing nib projects from the ferrule and extends into the reservoir.

The ferrule member and the barrel member have adjacent skirt portions in telescoping assembled relation for normally mechanically urging the ferrule and barrel together in axial alignment. Additionally, the skirt portions, when moved longitudinally one into the other, afford fastening means, sealing means and means for constraining relative rotation between the assembled ferrule member and the barrel member thereby providing a securely sealed and easily assembled housing for a writing instrument.

11 Claims, 6 Drawing Figures

WRITING INSTRUMENT WITH BARREL AND FERRULE ASSEMBLY

BACKGROUND OF THE INVENTION

1. Field of the Invention

This invention relates to writing instruments and, more specifically, to a housing assembly for a writing instrument formed by mechanically uniting a ferrule member and a barrel member to provide an internal chamber for writing fluid.

2. Description of the Prior Art

Modern writing instruments of the type comprising a hollow barrel which holds a reservoir for writing fluid and a nib projecting through a ferrule for transporting fluid from the reservoir to a writing surface are well known. The nib is generally mounted in and projects from the ferrule which is attached to the barrel holding the fluid reservoir for the writing instrument. Such writing instruments are preferably made of inexpensive material, such as polypropylene, nylon or other plastic materials, so that the instruments are disposable and are discarded upon complete use of the writing fluid therein contained.

Conventionally, the barrel and ferrule of such writing instruments have been assembled by welding, by chemically bonding, by a press fit operation, or by screwing the ferrule to the barrel to enclose a previously inserted fluid reservoir in the capsular internal chamber. The ferrule generally has an end portion which is inserted into an open end of the barrel.

One popular method of forming such a housing assembly from a barrel and ferrule which is used in automatic production is known as spin welding. In the spin welding technique, the adjacent complementary portions of the ferrule and the barrel are each of mating circular cross section and of a size to be inserted one within the other.

To this end, the barrels are normally advanced in a row side-by-side on an assembly line. A fluid reservoir is inserted into each barrel and filled with ink (if not pre-filled). The ferrule is then positioned in alignment with the barrel, and the end portion of the ferrule is inserted into the adjacent end portion of the barrel so that the surfaces of the end portions contact one another. The barrel or the ferrule is then rotated relative to the other at high speed. The frictional contact between the surfaces of the two end portions melts and fuses the plastic material of the adjacent surfaces of the ferrule and the barrel to unite the parts into a housing assembly for a writing instrument. This procedure may be effected by gripping and spinning the ferrule while the barrel is held stationary and in alignment with the ferrule.

After the spin welding operation, a nib is inserted through the bore of the nib holder at the exposed end of the ferrule and into contact with the fluid reservoir positioned within the housing assembly.

Although carefully supervised spin welding techniques have been satisfactory for production, they incorporate certain disadvantages. The ferrule and the barrel must be composed of the same, or at least compatible, plastic materials to assure that a continuous, permanent and leak-proof weld is obtained in the contiguous surfaces of the parts. Generally, the plastic materials must be identical. However, different plastic materials are sometimes necessary for use with different types of inks. Each ferrule and barrel of the differing plastic being identically formed are indeterminable as to composition. If an inadvertent attempt is made to weld a ferrule of one plastic material to a barrel of a different plastic material, the fusing of the contiguous surfaces may be incomplete or wholly defective. This flaw is not necessarily apparent from visual inspection. Thus, for instance, in removing the cap from a finished instrument, the ferrule may become disengaged from the barrel resulting in leakage or spillage of the ink from the fluid reservoir upon the person using the writing instrument.

Even with plastic materials which are compatible for the spin welding technique, this same type of flaw may occur if the surface tolerances between the parts is too great. Again, due to incomplete fusing of the contiguous surfaces of the ferrule and the barrel, evaporation of the volatile solvent in the marking fluid may occur, the parts may become disengaged, or leakage of the writing fluid may result.

Ultrasonic welding procedures suffer from the same infirmities found in the spin welding technique. Chemical bonding or adhesive methods for joining the components are time consuming and uneconomical, in addition to suffering the problems incurred in maintaining proper alignment in the assembly operation. An adhesive must be compatible with differing materials if inadvertent mixing of different plastic components occurs, or if differing plastics are intentionally used. Application of adhesive material is difficult, and an excess of adhesive material applied can result in its oozing around the exterior of the connecting joint, making an unsightly, and possibly unsatisfactory, writing instrument housing.

In the techniques of spin welding, of electric ultrasonic welding and of chemical bonding, the equipment generally used, because of its complexity, requires considerable maintenance which often results in interruptions in the automated assembly operation. Such interruptions for maintenance causes production losses and increased costs.

SUMMARY OF THE INVENTION

It is an object of the present invention to provide a solution for one or more of the problems set forth above.

According to the present invention, a housing assembly for a writing instrument is disclosed and comprises a hollow, cylindrically shaped barrel, and a ferrule having a cylindrically shaped skirt portion complementary to and engageable with an adjacent barrel skirt portion. The barrel skirt portion and the ferrule skirt portion, when joined in telescoping relation, have tapered surfaces in resilient engagement to create a vector force normally urging the ferrule member and barrel member toward each other. Additionally, when so joined, the skirt portions have means for preventing relative rotation between the barrel and the ferrule and cooperating mechanical fastening means and sealing means. Thus, the housing assembly of the writing instrument may be quickly and securely assembled by a press fitting operation utilizing an air cylinder in which the ferrule skirt portion is moved longitudinally into contiguous engagement with the complementary skirt portion of the barrel. The barrel and ferrule can each be easily and readily manufactured by common plastic molding techniques with appropriate tolerances between the interfitting and telescoping parts.

The ferrule member and the barrel member are each composed of a material and properly designed such that each is slightly resiliently flexible. Each member has an elastic memory of shape such that it tends to recapture its originally molded form.

The means for normally urging the barrel toward the ferrule when in assembled relation includes cooperating ring members on the skirt portions, each ring member having an annular tapered surface resiliently engaging the tapered surface of the other ring member to create a vector force urging the barrel and ferrule toward each other. In the preferred embodiment, two pairs of such ring members and two pairs of such tapered surfaces are utilized.

Means are provided to prevent relative axial rotation between the barrel and the ferrule. To this end, the ferrule skirt portion and the complementary barrel skirt portion are each provided with a plurality of ribs, or elements of similar shape, extending longitudinally along the combined axis of the barrel and the ferrule, projecting radially, and being circumferentially spaced, such that when the barrel and ferrule are assembled, the adjacent ribs on one part will interpose the adjacent ribs on the complementary part and become interfittingly engaged. Preferably, but not necessarily, the number of ribs formed on the barrel skirt portion and on the ferrule skirt portion are the same. The preferable embodiment of this invention comprises 60 ribs on each, the ferrule and the barrel, extending longitudinally of their lengthwise axis, at 6° spacings circumferentially about the diameters of the respective cylindrical shapes of each. When the ferrule skirt portion is pressed in contact with the barrel, the ribs will mesh in interposed alignment with minimal rotational movement between the barrel and the ferrule, thereby firmly constraining the relative axial rotation of the barrel and the ferrule with one another when assembled.

The sealing means to prevent egress of marking fluid from between the skirt portions is preferably provided by the intimate resilient engagement between the opposed and complementary tapered surfaces of the ring members. As the skirt portions are relatively moved longitudinally to telescoped position, the ring members initially make interferring contact; however, further longitudinal movement causes one ring member to cam or deflect the other ring member by deforming the resilient material of the adjacent parts so that the one ring member rides past the other ring member to position the annular tapered surfaces in intimate resilient sealing engagement when the skirt portions are in fully telescoped, assembled position.

In such fully telescoped position, the one ring member is also captured by the other ring member to afford a mechanical fastening means for latching the ferrule member and barrel member together. Preferably, this mechanical fastening means is strengthened by an auxiliary fastening means formed from a second pair of similar ring members positioned longitudinally of the first pair of ring members which lends increased stability and durability to the joined and telescoped skirt portions. The auxiliary fastening means prevents disengagement of the ferrule from the barrel by bending or rocking action between these assembled components, as may be applied by transverse forces, and also affords a second seal between the skirt portions of the barrel and ferrule. The principal sealing action occurs between the tapered surfaces of the innermost pair of ring members.

The foregoing invention allows a ferrule and barrel of a writing instrument to be assembled by a simple longitudinal press fit movement of the parts, thus eliminating the need for spin welding, or similar assembling methods, yet preventing relative rotation between the components and providing effective mechanical fastening and sealing between such component parts to prevent leakage and inadvertent separation.

Other objects and advantages of this invention will be apparent from the following detailed description, the drawings, and the appended claims.

DETAILED DESCRIPTION OF THE INVENTION

Figures 1, 2, 3:
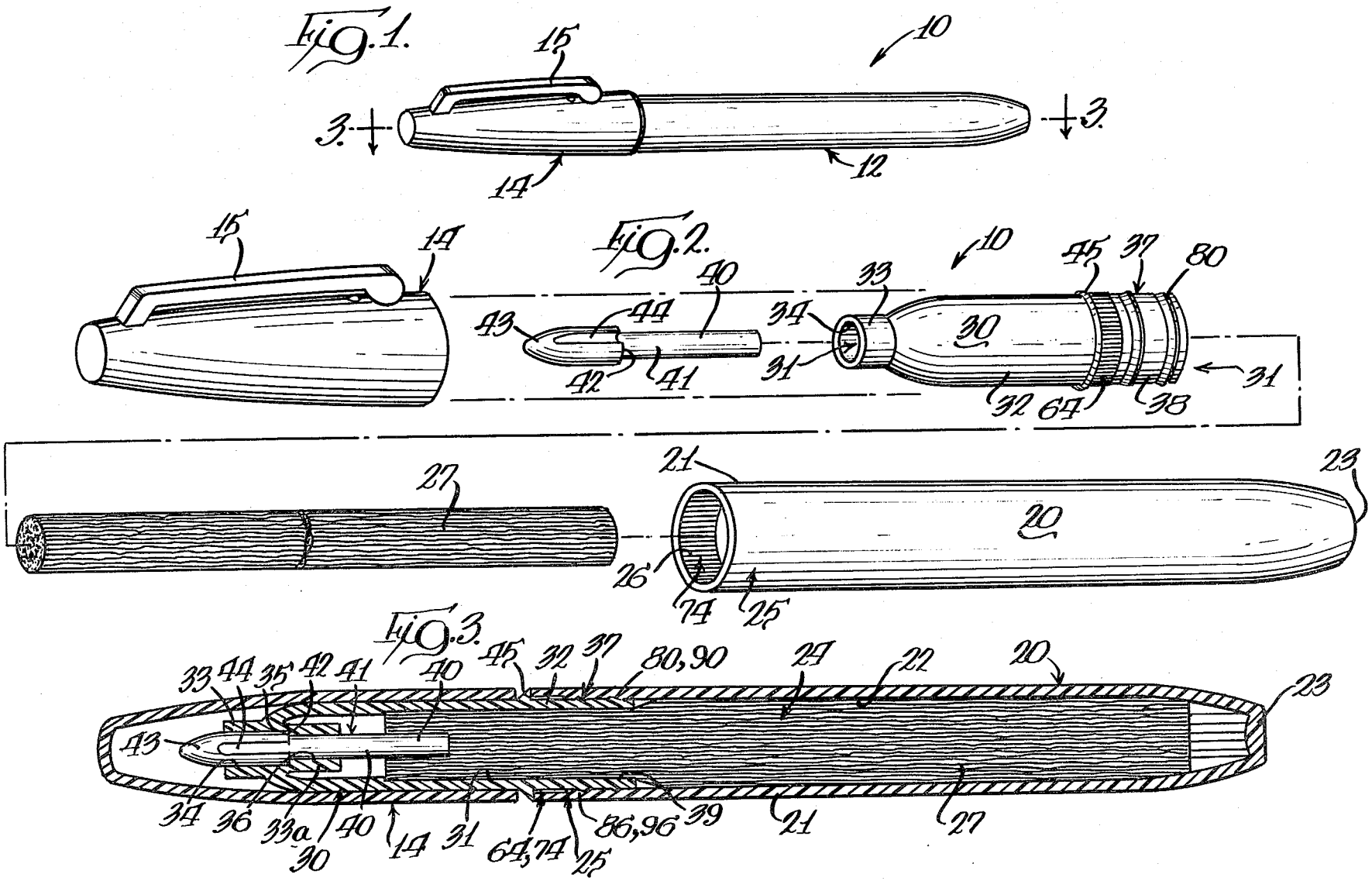
FIG. 1 is a side perspective view of a writing instrument made according to the invention.
FIG. 2 is an enlarged, exploded perspective view of the writing instrument of FIG. 1.
FIG. 3 is an enlarged sectional view of the writing instrument of FIG. 1 taken generally along line 3—3 of FIG. 1.

FIGS. 1-3 illustrate a writing instrument, generally designated 10, made according to the invention. The instrument 10 generally comprises a body or housing assembly 12 and a cap 14 of such a size to frictionally engage the writing end of the housing 12 when the writing instrument is not in use. A conventional clip 15 is provided on the cap 14.

The housing 12 comprises an elongate, hollow, cylindrically shaped, barrel member generally designated 20 and a ferrule member, generally designated 30. The barrel member is formed by a cylindrically shaped wall 21, preferably circular in cross section, which has a similar cylindrically shaped inner surface 22, closed at its rearward distal end 23, forming an inner chamber 24. The forward end of the barrel 20 has a barrel skirt portion, generally designated 25, which is circularly shaped in cross section and has a forwardly opening end 26. The inner chamber 24 of the barrel is intended to hold a loosely fitting writing fluid reservoir 27 which is formed from an elongate generally cylindrical bundle of porous fibrous material, such as cellulose fibers. This fluid reservoir 27 retains and stores a quantity of writing fluid, usually injected into the fibrous material.

The ferrule 30 has a longitudinal cylindrically shaped passageway 31 extending therethrough which is formed by a cylindrically shaped body portion 32. A small cylindrical nib holder 33 is formed forwardly of the body portion 32 and is shaped to provide a bore 34 of such a size to closely receive a writing head 43 of a porous capillary writing nib 41. The inner surface of the nib holder 33 is provided with an annular abutment 35 spaced inwardly of the bore 34 to engage a shoulder 42 of the nib 41 and limit inward movement of the nib 41 into the nib holder 33. The nib holder 33 is also provided with an embracing portion **33*a* shaped to afford a smaller counterbore 36** extending rearwardly of the abutment 35 to frictionally embrace a rearward cylindrical shank portion 40 of the nib 41 so as to hold the writing head 43 in operative position.

A ferrule skirt portion, generally designated 37, is formed on the rearward end portion of the ferrule 30. The ferrule skirt portion 37 is generally circular in cross section to afford an outer lateral surface 38 and terminates with an opening 39 in the rear end of the ferrule 30. The barrel 20 and the ferrule 30 are preferably formed of a resiliently flexible material, such as polypropylene, nylon or similar plastic materials.

During a writing operation, as best seen in FIG. 3, writing fluid passes by capillary action from the reservoir 27 to the capillaries of the rearward shank portion 40 embedded in the reservoir 27 and then forwardly through the shank 40 to the writing head 43 which is exposed forwardly of the nib holder 33. In order to provide access of ambient air pressure throughout the length of the inner chamber 24 of the barrel to assure pressure equalization therein, a groove or depression 44 is formed in the nib 41 to afford an air passage leading through the nib holder 33 of the ferrule 30 to the inner chamber 24 of the barrel 20.

The adjacent skirt portions, 25 on the barrel and 37 on the ferrule, are each of a size to fit one within the other when the barrel 20 and ferrule 30 are moved longitudinally toward each other into contiguous engagement, and the interfitting of the two skirt portions mechanically fastens the ferrule 30 to the barrel 20 and securely constrains the ferrule 30 against relative axial rotation with respect to the barrel 20 at all times. This feature not only provides a quick and easy press fit assembly, but it also assures that the ferrule 30 will not become disengaged from the barrel 20 inadvertently if the cap 14 is twisted in removing the cap from the writing instrument housing assembly.

As herein shown in the preferred embodiment, the skirt portion 37 of the ferrule is inserted into the skirt portion 25 of the barrel 20 with inward movement of the ferrule limited by a transverse projecting annular shoulder 45 on the skirt portion 37 which is brought into abutment with the forward end of the barrel 20.

The housing assembly of the writing instrument is provided with means to prevent relative axial rotation between the assembled barrel 20 and ferrule 30. As herein shown, this means for preventing relative axial rotation includes a plurality of circumferentially spaced, longitudinally extending, radially outwardly projecting ribs or elements 64, of similar shape, on the outer surface 38 of the skirt portion 37 of the ferrule, which cooperate and interfit with a plurality of longitudinally extending, circumferentially spaced, radially inwardly projecting ribs or elements 74, of similar shape, formed on the inner surface 22 of the skirt portion 25 of the barrel. The ribs 64 and 74 are complementary to each other and are positioned for interengagement with each other when the ferrule is fully inserted into the barrel, with the ribs 64 being spaced inwardly and forwardly of ferrule skirt opening 39 and the ribs 74 being positioned adjacent and extending rearwardly of barrel skirt open end 26.

Figures 4, 5, 6:
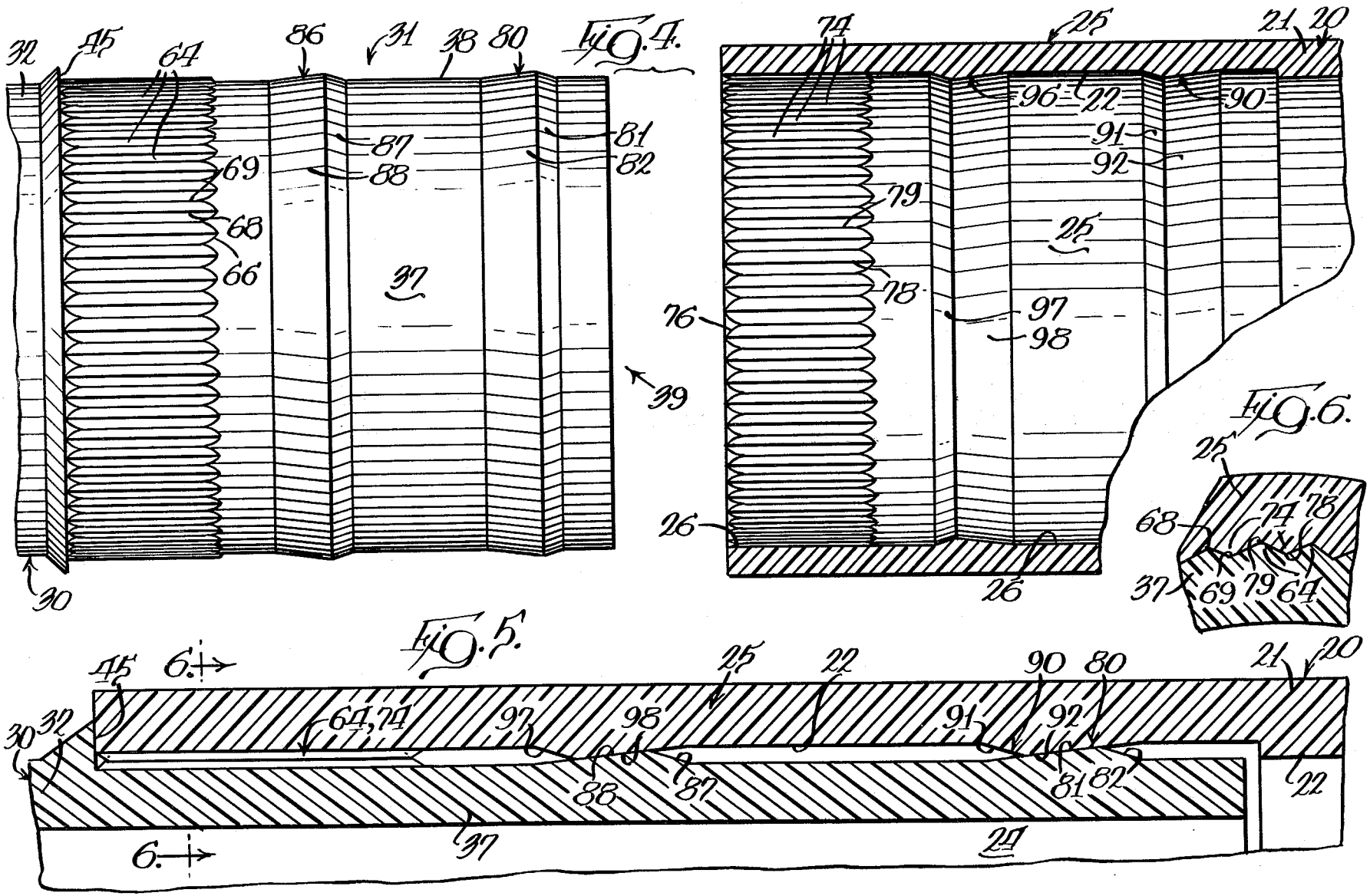
FIG. 4 is an enlarged, exploded, broken view, partly in section, of a portion of the ferrule member and barrel member of the writing instrument of FIGS. 1—3.
FIG. 5 is an enlarged sectional view of a portion of the ferrule member and barrel member of the writing instrument of FIG. 3.
FIG. 6 is a sectional view of the ferrule member and barrel member of FIG. 5 taken generally along line 6—6 of FIG. 5.

Each of the ribs or elements 64 and 74 has an exposed edge 66, 76 which is generally arcuate, resembling the prow of a ship, so that the ribs 64 and 74 are self-centering with respect to each other when the ferrule 30 is moved longitudinally into the barrel 20 to assure automatic interengagement of the sets of ribs 64, 74 by this longitudinal movement. There are preferably an equal number of ribs 64 and 74, and each set of ribs 64, 74 may include sixty ribs in a set with each rib spaced apart by 6° at their respective crests 68, 78 and respective intermediate roots or depressions 69, 79. Thus when the ferrule is being inserted longitudinally into the barrel, the leading edges 66, 76 tend to cam and to guide each rib 64 automatically into engagement between its complementary ribs 74 without regard to the initial positioning of the ferrule 30 and the barrel 20 prior to the longitudinal movement toward each other. Thus the sets of ribs 64, 74 tend to make an extremely close and intimate gear-like engagement, as best shown in FIG. 6. Preferably, the set of ribs 64 is very slightly over-sized with respect to the set of ribs 74 so that the sets of ribs are resiliently urged toward each other when in engaged position.

Means are provided on the skirt portions 25, 37 for normally urging the barrel member 20 and the ferrule member 30 toward each other when the ribs 64, 74 are in interfitting engagement with the ferrule fully seated in the barrel.

To this end, an annular first ring member 80 is preferably provided on the ferrule skirt portion 37 projecting outwardly from the outer surface 38. The ring member 80 is of larger diameter than the skirt portion 37, as seen in FIG. 4, and is provided with an annular cam surface 81 and a trailing annular tapered surface 82. The tapered surface 82 preferably is in the shape of the lateral surface of a truncated right circular cone.

Referring to the barrel skirt portion 25 in FIG. 4, an annular second ring member 90 is preferably provided projecting inwardly from the inner surface 22. The ring member 90 is of smaller diameter than the skirt portion 25, and is provided with an annular cam surface 91 and an annular tapered surface 92 shaped to engage complementarily the tapered surface 82 on the ferrule.

The ring members 80, 90 are of a size to make interferring contact with each other when the ferrule skirt portion 37 is moved longitudinally into the barrel skirt portion 25. The ring member 80 is also slightly over-size with respect to the inner diameter of the barrel skirt portion 25 so that the resilient material in each of the walls forming the skirt portions 25, 37 is resiliently deformed by the ring member 80 as a ferrule skirt portion 37 is telescoped into barrel skirt portion 25. Thus the resilient materials forming each annular wall of the skirt portions 25, 37 are normally urged toward each other when the skirt portions are in fully telescoped relationship.

A second pair of annular members, namely ring members 86, 96, similar in structure and function to ring members 80, 90 are preferably provided on the skirt portions 37 and 25, respectively. The ring member 86 is shaped to provide an annular cam surface 87 and a trailing annular tapered surface 88; and the ring member 96 is shaped to provide an annular cam surface 97 and an annular tapered surface 98. Preferably the outer diameter of ring member 86 is slightly less than the outer diameter of first ring member 80, and the inner diameter of ring member 96 is slightly greater than the inner diameter of second ring member 90, for reasons which will subsequently be made apparent.

Thus when the skirt portion 37 is pressed inwardly of skirt portion 25, ring member 80 rides past barrel ribs 74 and ring member 96 caused by deflecting engagement between cam surface face 81 and cam surface 97; and as ferrule ribs 64 move into interfitting engagement with barrel ribs 74, cam surfaces 81, 91 engage and resiliently deform the walls of skirt portions 37, 25 to permit first ring member 80 to ride past second ring member 90 so that tapered surfaces 82, 92 are brought into engagement. The deflected or deformed walls of skirt portions 37, 25 each tend to seek its original shape and each urges the tapered surfaces 82, 92 toward each other.

Because of the angled relation between the tapered surfaces 82, 92 a vector force is created urging the ferrule member 30 toward the barrel member 20 to retain the skirt portions 37, 25 in telescoped and fully seated position, one within the other, with the ribs 64, 74 maintained in interfitting engagement.

In the preferred embodiment, as the skirt portions 37, 25 become fully seated, the tapered surfaces 88, 98 of the second pair of ring members 86, 96 are brought into resilient engagement in the same manner as described above.

Since the marking fluid has a low viscosity and will move through small capillary passages such as in the nib 41 and the fibrous reservoir 27, the adjacent skirt portions 25, 37 when assembled must maintain an effective sealing means to prevent evaporation of volatile writing fluid solvent and the egress of marking fluid between the surfaces of the adjacent skirt portions 25, 37. The sealing means herein is afforded by the intimate resilient engagement between tapered surfaces 82, 92 and 88,98. These pairs of tapered surfaces are pressed together throughout a substantial annular area, as shown in FIG. 5, by the resiliently deflected walls of the adjacent skirt portions 37, 25 to provide a particularly effective seal.

As pointed out earlier, preferably tolerances are maintained between tapered surfaces 82, 92 and 88,98 so that the tightest and most effective seal is made between the innermost tapered surfaces 82, 92 which provide sealing action most nearly adjacent to the writing fluid in the reservoir. A secondary, auxiliary seal is provided between tapered surfaces 88, 98 of the second pair of ring members 86, 96.

The present structure also provides mechanical fastening or latching means effectively securing the barrel skirt portion 25 to the ferrule skirt portions 37 in fully telescoped position. This mechanical fastening occurs as the ribs 64, 74 are moved fully into interfitting engagement. The first ring member 80 rides past and is captured or latched by the second ring member 90; while at the same time, the ring member 86 rides past and is captured or latched by the ring member 96. While the writing instrument may be constructed with a single pair of ring members as a latching means, it is preferred to use the two pairs of ring members 80, 90 and 86, 96 which add stability and strength to the fastening function. In other words, with dual latching, the ferrule canot be rocked or angularly moved with respect to the axis of the barrel to disengage the adjacent skirt portions 25, 37 as may be possible if a single latch means is employed.

The structure of the present invention accomplishes a number of important functions in a writing instrument with a simple press fit assembly operation. It secures the ferrule against relative axial rotation with respect to the barrel; it causes the ferrule and barrel to be normally urged toward each other when assembled; it provides an effective seal between adjacent parts of the ferrule and the barrel; and it provides an effective mechanical fastening of the ferrule to the barrel. Additionally, it allows the barrel 20 and the ferrule 30 to be made of different plastic materials as may be desired in some cases. The invention provides for quick assembly of readily moldable parts to facilitate mass production of writing instruments, and its structure preserves an attractive and uniform outside appearance of each instrument. Importantly also, it eliminates untimely accidents in which writing fluid is spilled when the ferrule and barrel become disconnected in an occasionally defectively made writing instrument.

While the invention is especially suitable for use in forming a barrel and ferrule into a housing assembly for a writing instrument, it is also well suited for use in other dual component assemblies requiring complementary engagement between two cylindrically shaped bodies.

The foregoing description is given for clearness of understanding only and no unnecessary limitations should be implied therefrom, as modifications will be obvious to those skilled in the art.

I claim:

1. In a writing instrument of the type having a reservoir for marking fluid and a writing nib for carrying marking fluid from the reservoir to a surface to be marked, a housing assembly for the writing instrument, comprising:

an elongate hollow barrel member having an inner chamber to receive the reservoir, the barrel member having a closed rear distal end;

a ferrule member positioned in longitudinal alignment forwardly of the barrel member, the ferrule member having a passageway therethrough and a free end shaped to snugly receive the writing nib, at least one of said barrel and ferrule members being of resilient material;

adjacent skirt portions on the barrel member and the ferrule member for securing the ferrule member against relative axial rotation with respect to the barrel member, the skirt portions having adjacent open ends and being of a size to make a close mating fit one within the other when moved longitudinally toward each other, the one skirt portion having an outer surface of circular cross section and the other skirt portion having an inner surface of circular cross section, each of said surfaces having peripherally spaced elements positioned for interfitting engagement to prevent said relative axial rotation when the one skirt portion is moved longitudinally into the other skirt portion; and means on the skirt portions for urging the ferrule member toward the barrel member when the peripherally spaced elements are in interfitting engagement.

2. A housing assembly as specified in claim 1, in which the peripherally spaced elements on each of the surfaces of the adjacent skirt portions are sets of complementary ribs, one set extending radially inwardly from the outer surface and the other set extending radially outwardly from the inner surface.

3. A housing assembly as specified in claim 2, in which the ribs of each set are of substantially the same size and shape, and each rib has a tapering prowlike end so that the ribs of each set will be directed into self-centering relationship during longitudinal movement of the one skirt portion toward the other skirt portion.

4. A housing assembly as specified in claim 1, in which the skirt portion of the ferrule member is of a size to make a close mating fit within the skirt portion of the barrel member.

5. A housing assembly as specified in claim 1, in which the means for urging the ferrule member toward the barrel member comprises an annular first ring member projecting outwardly from the outer surface of the one skirt portion and being of larger diameter than the one skirt portion, and an annular second ring member projecting inwardly from the inner surface of the other skirt portion and being of smaller diameter than the other skirt portion, said first ring member having a first annular surface tapered toward the outer surface and said second ring member having a second annular surface tapered toward the inner surface, said ring members being of a size to make interferring contact as said one skirt portion is moved into the other skirt portion, the ring members deflecting the resilient material to permit one of the ring members to ride past the other of the ring members when the peripherally spaced elements are moved into interfitting engagement to position the first and second annular tapered surfaces in resilient engagement resulting from the deflection of the resilient material, said resilient engagement causing a vector force urging the barrel member toward the ferrule member.

6. A housing assembly as specified in claim 5, in which the first ring member has a camming surface to facilitate movement of one of the ring members past the other ring member when the peripherally spaced elements are moved into interfitting engagement.

7. A housing assembly as specified in claim 5, in which the second ring member has a camming surface to facilitate movement of one of the ring members past the other of the ring members when the peripherally spaced elements are moved into interfitting engagement.

8. A housing assembly as specified in claim 7, in which the one skirt portion is on the ferrule member and the other skirt portion is on the barrel member.

9. A housing assembly as specified in claim 8, in which the peripherally spaced elements on the ferrule member are spaced inwardly of the open end of the one skirt portion and the first ring member is positioned intermediate the peripherally spaced elements and the open end of the one skirt portion, and the second ring member is positioned inwardly of the open end of the other skirt portion with the peripherally spaced elements on the other skirt portion being positioned intermediate the second ring member and the open end of the other skirt portion.

10. A housing assembly as specified in claim 5, in which the first and second annular tapered surfaces are peripherally in intimate engagement to provide a seal to prevent egress of marking fluid from the reservoir.

11. A housing assembly as specified in claim 5, in which the first and second ring members afford a latch means to retain the ferrule member and barrel member in assembled relation when the peripherally spaced elements are moved into interfitting engagement.

* * * * *